US005660136A

United States Patent [19]

Pignatelli et al.

[11] Patent Number: 5,660,136

[45] Date of Patent: Aug. 26, 1997

[54] DRIVE UNIT SAFETY BOOT

[76] Inventors: Robert Pignatelli; Audrey Cohn, both of 2 Oakleaf Dr., Clifton Park, N.Y. 12065; Nicholas Pignatelli; Joyce M. Pignatelli, both of 3 Cayuga Ct., Albany, N.Y. 12208-1067

[21] Appl. No.: 562,171

[22] Filed: Nov. 22, 1995

Related U.S. Application Data

[63] Continuation-in-part of Ser. No. 438,836, May 11, 1995, abandoned.

[51] Int. Cl.[6] ..... B63B 17/00

[52] U.S. Cl. ..... 114/361; 116/28 R; 150/154

[58] Field of Search ..... 114/270, 219, 114/361, 343, 222; 150/154, 157, 166, 167, 165; 296/136; 116/26 R–28 R, 200, 307; 440/900

[56] References Cited

U.S. PATENT DOCUMENTS

| | | | |
|---|---|---|---|
| 2,498,113 | 2/1950 | Milner . | |
| 2,801,667 | 8/1957 | Curran . | |
| 3,870,875 | 3/1975 | Altimus . | |
| 4,887,318 | 12/1989 | Weinreb | 224/264 |
| 4,998,496 | 3/1991 | Shaw, III . | |
| 5,072,683 | 12/1991 | Colonna . | |
| 5,193,724 | 3/1993 | Robbins | 150/167 |

FOREIGN PATENT DOCUMENTS

| | | | |
|---|---|---|---|
| 004400392 | 6/1994 | Germany | 296/136 |

*Primary Examiner*—Edwin L. Swinehart
*Attorney, Agent, or Firm*—Schmeiser, Olsen & Watts

[57] ABSTRACT

A collapsible cover for the drive unit of an outboard or sterndrive boat is provided. The cover is releasably secured to the drive unit by an adjustable sleeve that fits around an upper part of the unit. Each of the cover's sides includes an impact absorbing pad that functions to protect swimmers or other people in the area of the drive unit from coming into direct contact with the unit. The pads also protect the drive unit from being damaged by tools or other objects accidentally impacting on the unit.

29 Claims, 5 Drawing Sheets

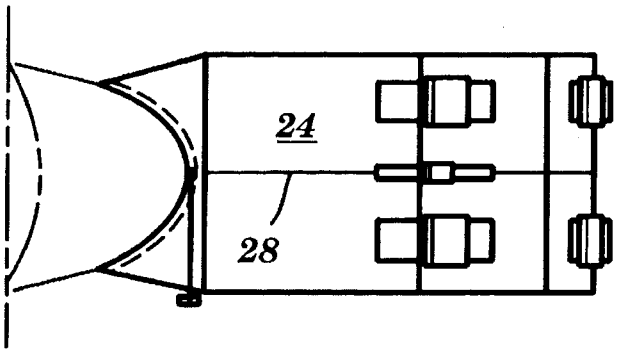
FIG. 2
FIG. 3
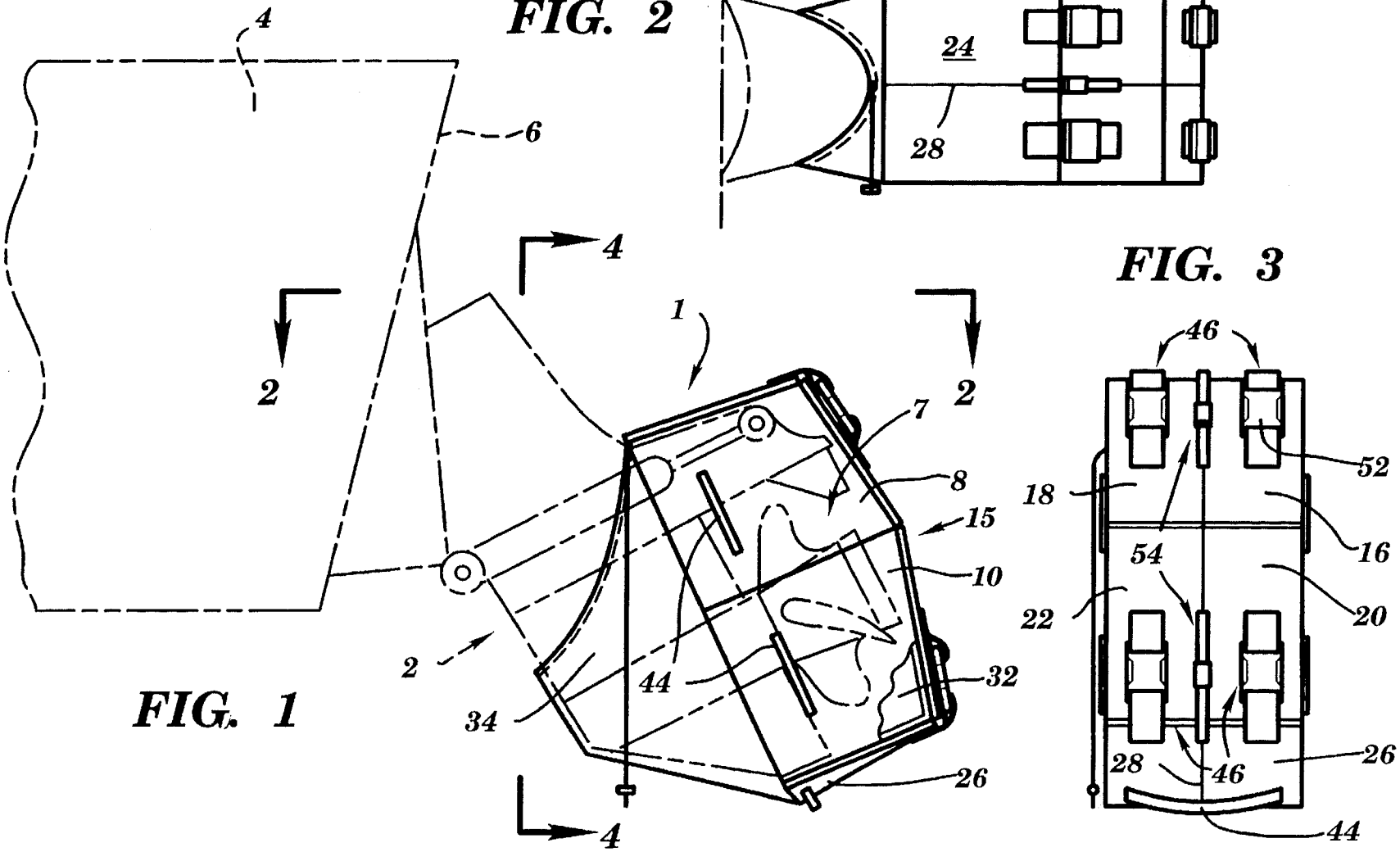
FIG. 1

62
54
64
66
60

60
44
54
50
1

4
1
34
38
12
14
56

38
42
56
34
40
36

DRIVE UNIT SAFETY BOOT

This application is a continuation-in-part of 08/438,836, filed May 11,1995, now abandoned.

FIELD OF THE INVENTION

The invention is in the field of boat accessories. More particularly, the invention is a protective covering adapted to fit over the drive unit portion of a sterndrive or outboard motor. The covering defines an enclosure that is releasably secured to the drive unit. The cover includes a plurality of cushioning sections that are located to surround the drive unit and thereby form a protective barrier around the unit. When not needed, the cover may be folded or rolled into a compact form and easily stowed within the boat.

BACKGROUND OF THE INVENTION

There have been a number of covers developed over the years that are designed for placement about the drive unit portion of an outboard, a sterndrive motor system, or the like. The drive unit is hereby defined as the portion of an outboard motor located beneath the motor's powerhead, and the functionally equivalent portion of a stern drive system (a stern drive system has the engine located within the boat and connected to a drive unit that is affixed to and extends outwardly from the boat's transom). The drive unit therefore includes a number of relatively sharp surfaces including stabilizing and anti-cavitation fins, the propeller and the unit's skeg.

Relevant art covers in this field are designed to either isolate the drive unit from salt water or to protect it from the weather. The covers are in the form of flexible bags or rigid containers that fit around a boat's drive unit. Some of the covers are waterproof so that they can be used as a fresh water tank for flushing of the motor. The covers are typically quite bulky and are not easily stowable.

A common fear of boat owners is that people who are swimming in the area of their boat will accidentally come into contact with the boat's drive unit. Accidental contact can also occur when the boat is out of the water and on a trailer or other type of support structure. The sharp edges of the unit, including those of the propeller, make such contact extremely hazardous.

Another worry of boat owners is that the boat's drive unit may be damaged while the boat is docked or in storage. This can occur if an object is accidentally dropped on the unit or when a tool such as a hammer is being used in the area of the unit and accidentally contacts the drive unit. The fragility of the propeller and the complexity of the parts within the drive unit make even a slight blow a cause for concern.

SUMMARY OF THE INVENTION

The invention is a collapsible cover for a drive unit portion of an outboard or sterndrive powered boat. The cover functions to provide a protective barrier about the exterior of the drive unit. Located within the cover are a number of panels or sections arranged so that they form a shock absorbent wall completely around the unit. In this manner, people in the area of the drive unit are protected from inadvertent contact with the hard metal and sharp edges of the unit. In addition, the cover protects the unit against damage from exterior objects.

When the cover is in its operative condition, it is in the form of a rigid, roughly rectangular box, sized to substantially surround the drive unit. Located at the top of the box is a flexible sleeve that has a manually adjustable central opening. At one end of the box, there is preferably a double-zippered opening that extends from the bottom of the box to the sleeve. To secure the cover to a boat's drive unit, the unit is inserted through the opening in the sleeve and zipper and the cover is then pulled up around the unit. Once the cover is properly positioned on the drive unit, a drawstring is adjusted to reduce the diameter of the opening and thereby secure the cover to the unit. Additionally, a strap having a releasable closure means, such as a buckle, may be provided to further secure the cover to the unit.

Once the cover is no longer needed, it is removed from the drive unit. Then, buckle assemblies that maintain the cover in its rigid form are released so that the cover can be folded in a manner whereby its sides are stacked one atop another. Parts from two different ones of the buckle assemblies are then fastened together to lock the cover in its folded state. When the cover is in its folded condition, it has a size that is approximately equal to that of a conventional life preserver. This allows the cover to be easily stowed within the boat.

Alternatively, the cushioning cover may be maintained in rigid form by means of air bladder panels. In this case, the air is let out of the bladders, the end is unzipped, the drawstring and strap are undone, and the cover may be removed. Once the cover has been removed from the unit, it may simply be rolled up and placed within a carrying sack for easy stowing.

The exterior of the cover is preferably made of a fabric material such as nylon or DACRON. To make the cover more noticeable, the material is preferably of a highly visible color such as a bright red. One or more handles are secured to the exterior surface of the cover to facilitate the cover's installation or removal.

In the preferred embodiment of the invention, a brightly-colored strap is removably attached to one of the cover's handles or the carrying sack. The strap is designed to be removed from the cover or sack and secured to the boat's steering wheel when the cover is in place on the drive unit. The strap then functions to remind the operator of the boat that the cover is in place and that the boat's engine should not be started. In the preferred embodiment, the strap includes a plastic hook upon which the boat's ignition key may be hung to further ensure that the engine is not operated with the cover in place.

BRIEF DESCRIPTION OF THE DRAWINGS

FIG. 1 is a right-side view of a rear portion of a boat in which a cover in accordance with a first embodiment of the invention is located on the boat's drive unit;

FIG. 2 is a plan view taken at 2—2 of the boat portion and cover shown in FIG. 1;

FIG. 3 is a rear view of the cover shown in FIG. 1;

DETAILED DESCRIPTION OF THE DRAWINGS

Figure 8:
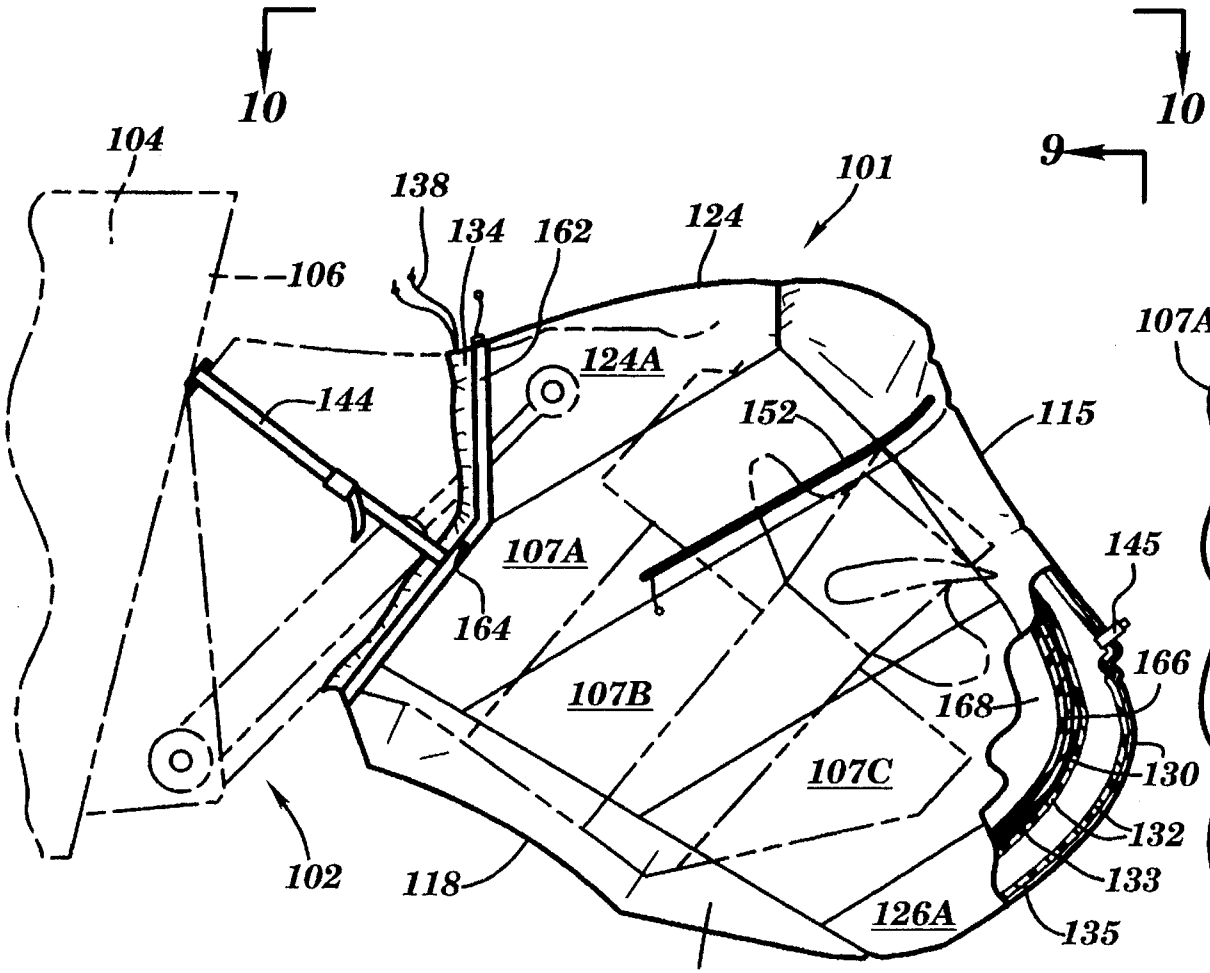
FIG. 8 is a right-side view of a rear portion of a boat in which a cover is shown with a partial cut-away in accordance with a second embodiment of the invention.
Figure 14:
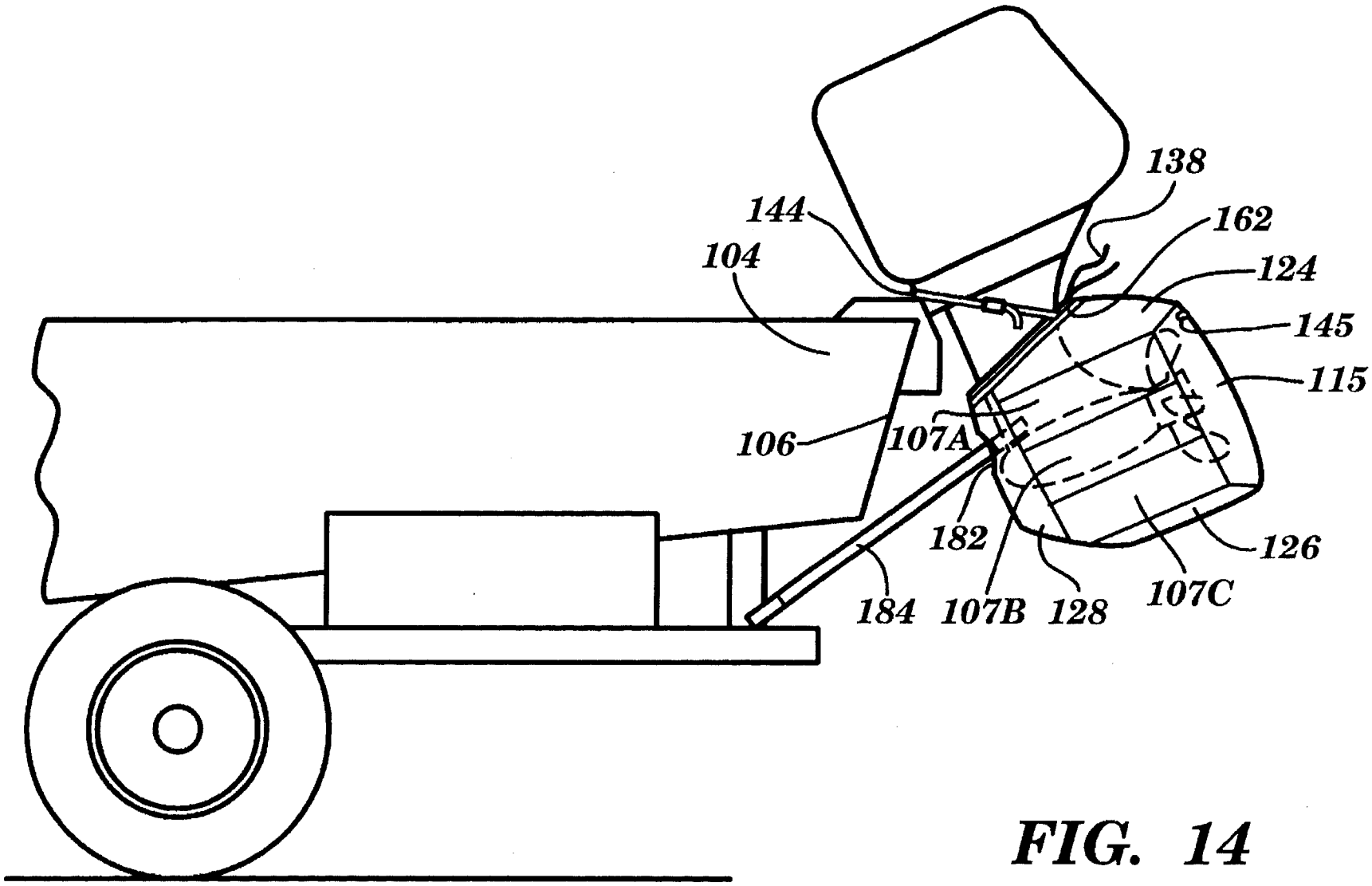
FIG. 14 is a right-side view of a rear portion of a boat in which a cover is shown in accordance with an optional second embodiment of the invention for use with an outboard motor.

Referring now to the drawings in greater detail, wherein like reference characters refer to like parts throughout the several figures, there is shown by the numeral 1 a cover in accordance with the invention. The cover is shown located about the drive unit 2 of a boat 4. The boat is powered by a sterndrive system in which the engine (not shown) is located within the boat and a drive shaft (not shown) connects the engine to the drive unit that extends outwardly from the boat's transom 6. It should be noted that the drive unit of a sterndrive is very similar in both function and appearance to the lower unit of an outboard motor, as can be seen in FIG. 8 and 14. In this application, a "drive unit" is also considered to be the lower unit of an outboard motor. The cover 1 may therefore also be used to cover the bottom portion of an outboard motor, as shown in FIG. 14.

Referring to FIGS. 1–7, there is shown a first embodiment of the cover including a right-side section 7 having two panels 8 and 10, a left-side section 11 having two panels 12 and 14 and a rear section 15 having four panels 16, 18, 20 and 22. The cover also includes a top section in the form of panel 24 and a bottom section in the form of panel 26. Both the top and bottom sections 24 and 26 have a central crease 28 to facilitate folding as will be described shortly.

Each of the cover's panels is in the form of an outer covering 30 of a flexible fabric material and an interior pad 32 of resilient foam material. The covering is preferably waterproof and may be, for example, a nylon or DACRON synthetic fabric or a cotton duck material. Each pad or cushion means 32 is planar and substantially rectilinear in shape with a thickness of approximately one-quarter to one-half inch. In the preferred embodiment, a semi-rigid block of closed cell foam is used for each pad.

Figures 4, 5, 6, 7:
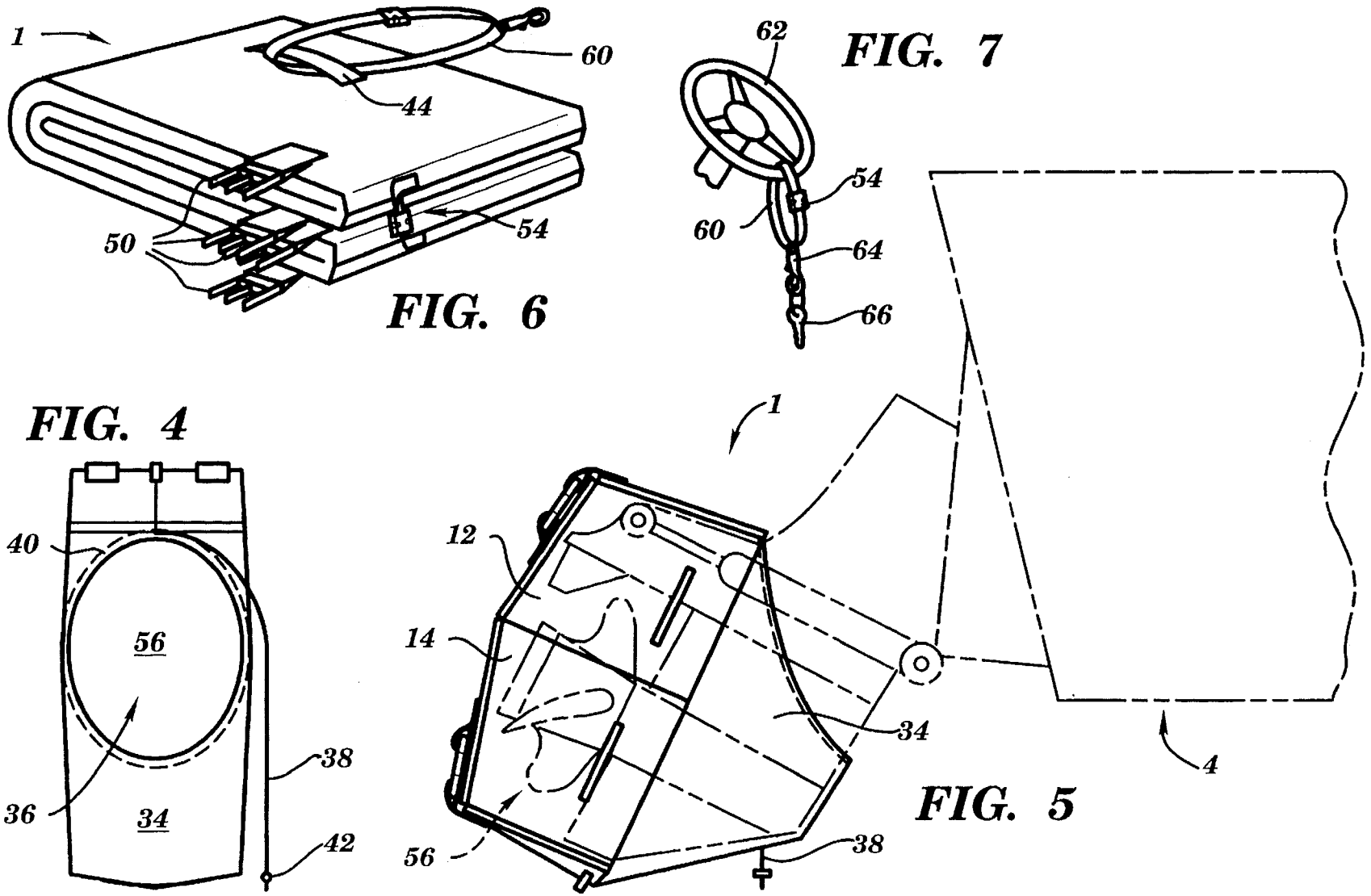
FIG. 4 is a front view of the cover shown in FIG. 1 taken at a point just forward of the cover in FIG. 1.
FIG. 5 is a left-side view of the cover and boat portion shown in FIG. 1.
FIG. 6 is a perspective side view of the cover shown in FIG. 1 with said cover in a fully folded condition.
FIG. 7 is a perspective view of a steering wheel with a reminder strap in accordance with the invention.

As can be seen in FIGS. 1–5, the cover includes a sleeve 34 that frames an opening 36 (note FIG. 4). The sleeve is a flexible member that is an extension of the outer covering 30 and does not include an interior foam panel. A cord 38 is partially located within the material of the outer edge 40 of the sleeve and encircles the opening 36. The size of the opening is adjustable by moving fastener 42 along the cord 38 to thereby cause the sleeve in the area of the opening to contract much in the same way as one would adjust a hood of a jacket. By adjusting the position of fastener 42 on the cord, one can cause the sleeve to tighten about the top portion of a drive unit to thereby secure the cover to the unit. Moving the fastener along the cord in the opposite direction allows the size of the opening to increase thereby enabling the sleeve and hence the cover to be easily removed from the drive unit. It should be noted that the cover may be secured using alternate attachment methods. One alternate method that is shown in FIGS. 8 and 14 is to use an adjustable length strap that is secured to the sides of the cover and that can be placed over and capture a top portion of the drive unit.

The exterior surface of the cover includes a plurality of strap-like handles 44. The handles facilitate installation or removal of the cover on a boat's drive unit.

The cover includes four large buckle assemblies 46 that are secured to the exterior surface of the panels as shown. Each of the buckle assemblies has a male portion 50 that is releasably engaged to a female portion 52. The cover also includes two Small buckle assemblies 54 with each assembly having a male portion and a complementary female portion to which it is releasably engaged.

It should be noted that the covering material 30 extends between and permanently connects the top section 24, the bottom section 26 and the side panels 8, 12 and 10 and 14. The buckle assemblies are used to releasably connect the top section 24 to the rear panels 16, 18 (note FIG. 2) and also to releasably connect the bottom section 26 to the rear panels 20,22 (note FIG. 3). When the cover 1 is in its operative condition, it forms a box-like enclosure having an open interior area 56. To make the box rigid, all six buckle assemblies are fastened as shown to thereby rigidly connect the rear panels to the adjacent panels of the cover.

When the cover is no longer needed, it is removed from the drive unit after the proper manipulation of cord 38. Once removed, the cover's sleeve 34 is pushed into the cover's interior. Next, all six buckles assemblies are released whereby the male portions are separated from the female portions. The rear panels 16–22 are then pushed into the interior area. This causes the top and bottom panels to bow outwardly and bend at their creases (since they are not connected to the rear panels but only to the side panels). The side panels are then folded against the rear panels and the top and bottom panels fully fold in half along their center creases 28. At this point, the cover is in the form of a long, relatively flat unit. The cover is then folded in half whereby it assumes the configuration shown in FIG. 6.

Once the cover has been folded in half, the male portion of the small buckle assembly 54 that was secured to the bottom section 26 is inserted into the female portion of the buckle assembly 54 that was attached to the top section 24. This locks the cover into the folded configuration shown in FIG. 6. It should be noted that once the cover has been folded as shown, it will have dimensions of approximately two feet long by two feet wide by one to two inches thick. The cover may be easily stowed within the boat in the same manner as one would stow a conventional life preserver. The cover may also be placed within an optional bag (not shown) prior to storage.

FIG. 7 shows a strap 60 that may be removably secured to one of the cover's handles 44 when the cover is not in use. When the cover is in use, the strap is removed from the cover and secured to the steering wheel 62 of the boat 4 as shown. The cover preferably includes a receiver 64 such as a plastic hook upon which the boat's ignition key 66 may be secured. The purpose of strap 60 is to remind the owner of the boat that the cover is in place on the drive unit and that the engine should not be operated. Hanging the boat's key on the strap further reduces the possibility that the engine would be started with the cover in place.

In a second embodiment of the present invention, the cover 101 comprises a top section 124, a bottom section 126, a right side section 107, a left side section 111, a front section 118 and a rear section 115. The right side section 107 is divided into three panels 107A, 107B, 107C. The left side section 111 is also subdivided into three panels 111A, 111B, and 111C. The top, bottom, front, and rear sections 124, 126, 118, and 115 respectively are each divided into two panels 124A and 124B, 126A and 126B, 118A and 118B, and 115A and 115B, respectively. Each of the panels 107A–C, 111A–C, 124A–B, 126A–B, 118A–B is a gas-filled bladder. The interior of each of the individual bladders opens into the adjoining bladders to permit air being pumped into the cover via a pair of valves 145 to fill all the bladders (note FIG. 11).

Figure 9:
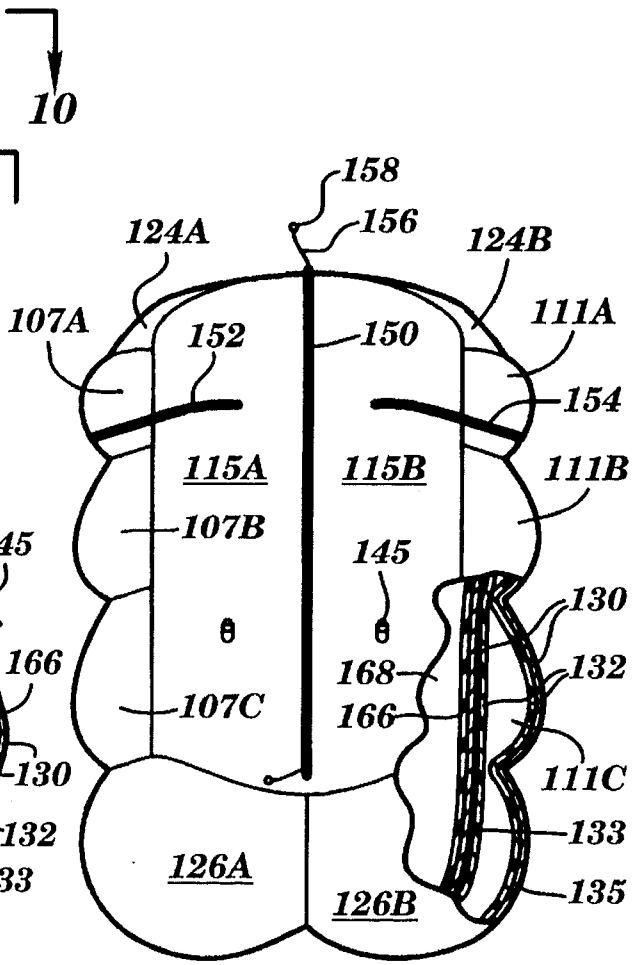
FIG. 9 is a front view with partial cut-away of the cover of the second embodiment of the present invention.
Figure 11:
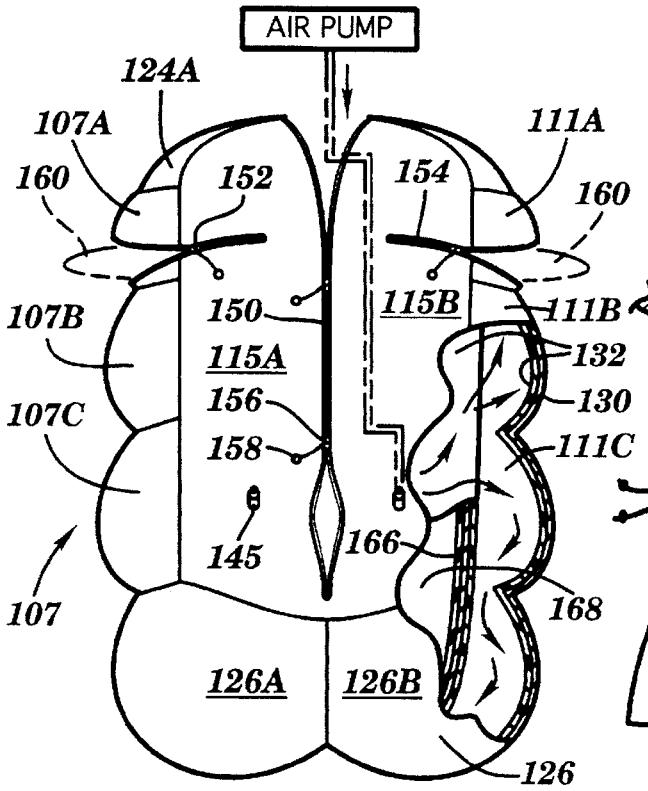
FIG. 11 is a front view with a partial cut-away of the cover of the second embodiment showing the passage of air into the cover and the zippered openings in an open position.

Each of the panels is in the form of an outer covering 130 having an outer material layer 135, an inner material layer 133 and a pocket defined therebetween of a flexible fabric material that is adhered to an inner liner 132 (note cut-away portions of FIGS. 8, 9 and 11). The covering is preferably waterproof and may be, for example, a nylon or DACRON synthetic fabric or a cotton duck material. Each inner liner 132 is made of a material that can hold a gaseous substance such as air, helium, carbon dioxide, etc. and is preferably a rubber material. The panels in the top, bottom, front and back sections are substantially rectilinear in shape while the side sections are substantially trapezoidal in shape. The thickness is approximately one-quarter inch when uninflated and approximately three inches when inflated.

Figure 10:
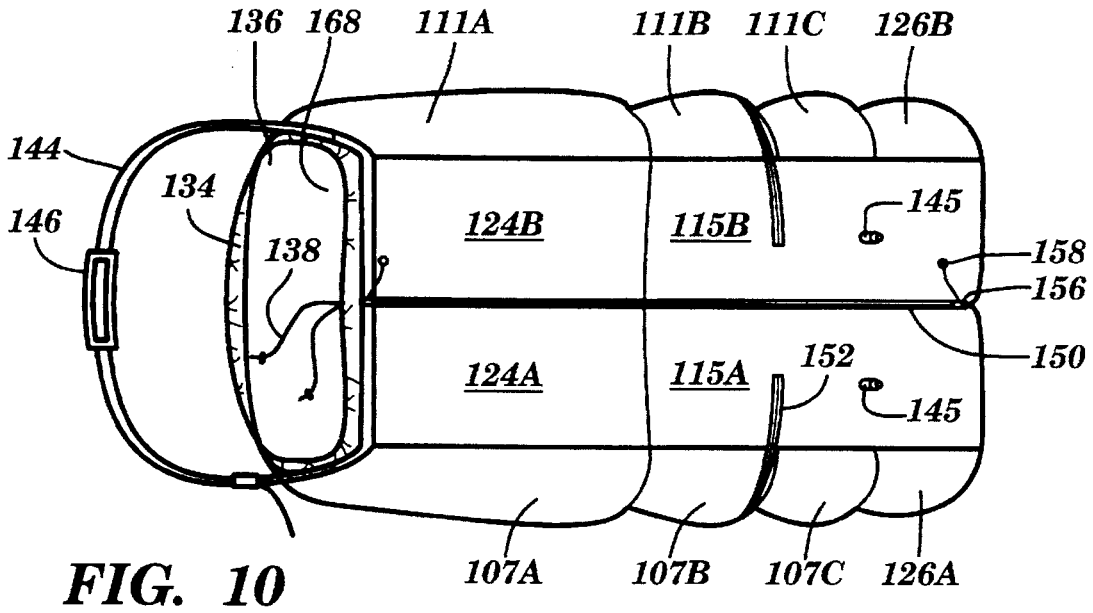
FIG. 10 is a top view of the cover of the second embodiment of the present invention.

As can be seen in FIGS. 8 and 10, the cover includes a sleeve 134 that frames an opening 136 (note FIG. 10). The sleeve is a flexible member that is an extension of the outer covering 130 and does not include an interior panel. A cord 138 is partially located within the material of the outer edge 140 of the sleeve and encircles the opening 136. The size of the opening is adjustable by pulling the cord to thereby cause the sleeve in the area of the opening to contract and then tying the ends of the cord together, much in the same way as one would adjust a hood of a jacket. It should be noted that the cover may be secured using alternate attachment methods. One alternate method, as shown in FIGS. 8 and 14, is to use an adjustable length strap 144 that is secured to the sides of the cover and that can be placed over and capture a top portion of the drive unit. In order to reduce friction between the motor and the strap, a pad 146 may be slid along the strap 144 and positioned along the strap so as to decrease the likelihood of damage from abrasion between the strap and the drive unit.

Additionally, zippers 150, 152, 154 are provided as shown in FIGS. 8, 9, 10 and 11. A first zipper 150 runs down the centerline of the top and rear sections, between each pair of panels 124A, B and 115A, B. This zipper is preferably provided with two slides 156 and pull tabs 158 so that one may zip and unzip the cover from the top or the bottom. A pair of second zippers 152 and 154 are provided in order to allow drive units further comprising hydrofoils 160 to be fitted into the cover. As shown in FIG. 11, the zippers can be unzipped and the hydrofoils 160 permitted to extend through the apertures created thereby. The hydrofoils may then be covered with a styrofoam cover (not shown) in order to protect the hydrofoils from inadvertent contact with a person.

Figure 12:
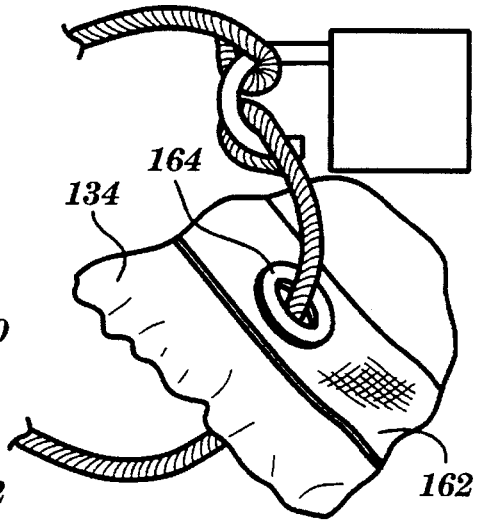
FIG. 12 is a close up view of one of the grommets showing how the cover may be locked to the unit for security purposes.

The cover 101 may also include a strip of webbing material 162 between the sleeve 134 and the outer covering 130, in order to reinforce the connection therebetween (note FIGS. 8, 10 and 12). The strip of webbing may further comprise at least two grommets 164 therethrough located at remote points from each other, so that a chain or cord may be passed therethrough and then secured with a padlock or other securing means (note FIG. 12). This serves as an anti-theft feature so that the cover is not stolen while the boat is unattended.

Another additional feature of the second embodiment of the present invention is a layer of material 166, preferably rubber, that may be attached to the interior of the cover 101 (note FIGS. 8, 9 and 11). The rubber material 166 preferably comprises two layers of rubber having a layer of fabric sandwiched therebetween for strength. The layer of rubber material may line the entirety of the open interior area 168 or the sections of the open interior area 168 which would come into contact with the blades of the propeller, the skeg and the anti-cavitation fins when the cover 101 is in use. This rubber material 166 is sewn into the cover at contact points along the "seams" between adjacent air-filled panels so as not to puncture the air-filled bladder. The contact points are where the interior rubber liners are adhered to each other in order to better maintain the proper shape of the cover and also forming the paneled appearance.

Figure 13:
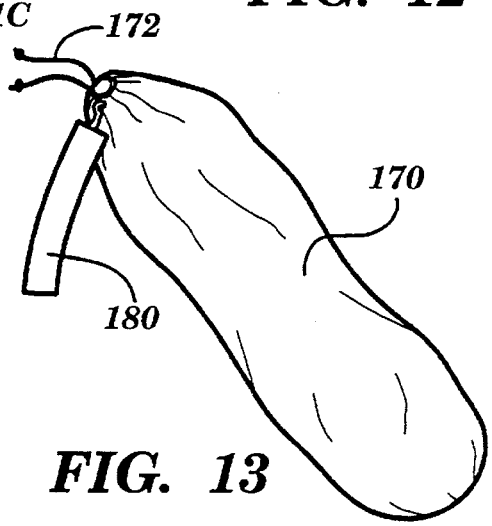
FIG. 13 is a perspective view of the carrying sack with the strap.

When the cover is not in use, the cover 101 may simply be rolled up and stuffed into a sack 170 (note FIG. 13). The sack 170 may be made of any flexible fabric material but is preferably made of a waterproof material like the outer covering 130. The sack 170 is generally cylindrical in shape and may include a drawstring 172 at the top opening. Releasably attached to the sack is preferably a strap 180 for attaching to the ignition key of the boat while the cover 101 is in use so as to remind the boat operator that the cover is in place and must be removed before the boat is turned on.

In an embodiment of the invention adapted to be used with an outboard motor, the cover 101 is substantially the same as described above. However, the top panels 124A and B are greatly reduced in size and the right side and left side panels, 107A–C and 111A–C respectively, are roughly rectangular in shape rather than trapezoidal (note FIG. 14). Additionally, there may be provided an aperture 170 for allowing a support bar 172 to pass therethrough. The support bar is used primarily during travel to hold the motor in the upwardly tilted position.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

We claim:

1. A collapsible cover assembly for in-and out-of-water use on a drive unit of a motor-powered boat, said cover assembly comprising:

a first side section, a second side section, a top section, a bottom section, a rear section and an opening that leads to an interior area located between said sections;

connecting means for connecting said sections together;

three or more cushioning pads wherein each of said sections includes at least one of said pads and wherein said pads are user-inflatable and deflatable bladders; and releasable securement means for releasably securing said cover assembly to a drive unit of a boat and wherein said opening is sized to fit around at least a portion of said drive unit and wherein the cover's sections are sized so that at least a portion of said drive unit that includes a propeller member can be received within said interior area of the cover.

2. The cover assembly of claim 1 further comprising a plurality of handles located on an exterior surface of the cover assembly.

3. The cover assembly of claim 1 further comprising a strap that is removably secured to said cover assembly when said cover assembly is in a collapsed condition and wherein when said cover assembly is located on a drive unit of a boat, said strap is secured to a remote steering wheel of the boat to remind an operator of the boat that the cover assembly is in place on the boat's drive unit.

4. The cover assembly of claim 3 further comprising a receiver means secured to said strap, wherein said receiver means is adapted to releasably secure an ignition key of the boat to the strap.

5. A cover for a drive unit of a motor-powered boat, said drive unit located aft of a transom of said boat and wherein said cover consists essentially of:

a first side, a second side, a top side, a bottom side, a rear side and an opening that leads to an open interior area located between said sides;

connecting means for connecting said sides together;

a cushion means located on each of said sides;

releasable locking means that functions to releasably lock together said sides to form a substantially rigid box having an opening and wherein when said locking means is in an unlocked condition, said cover can be folded into a flat shape with all of its sides stacked one atop another; and releasable securement means for releasably securing said cover to a boat's drive unit and wherein said opening is sized to fit around said drive unit and wherein said sides are sized so that at least a portion of said drive unit can be received within said open interior area of the cover.

6. The cover assembly of claim 5 wherein the connecting means includes a plurality of releasable buckle assemblies and wherein each buckle assembly includes a male portion and a complementary female portion.

7. The cover assembly of claim 6 wherein said rear section is connected to said top and bottom sections by the releasable buckle assemblies and wherein when said cover assembly is to be placed into a collapsed condition, said buckle assemblies are released to allow said top and bottom sections to be moved away from said rear section.

8. The cover assembly of claim 7 wherein when said cover assembly is in a collapsed condition, all of the sections are oriented in a stacked configuration and a male portion of one of said buckle assemblies is received within the female portion of a second of said buckle assemblies to thereby releasably secure the sections together.

9. The cover assembly of claim 5 wherein said securement means is in the form of a flexible sleeve having an adjustment means that functions to change the size of the cover assembly's opening.

10. The cover of claim 5 wherein said cushion means is in the form of a pad of soft material.

11. The cover of claim 5 wherein said cushion means is a gas filled bladder.

12. The cover of claim 5 wherein the releasable securement means is in the form of a flexible sleeve surrounding said opening and wherein said sleeve includes an adjustment means that functions to adjust a size dimension of said opening.

13. The cover of claim 5 wherein the releasable locking means is in the form of a plurality of buckle assemblies.

14. A collapsible cover for in and out of the water placement onto a drive unit of motor powered boat, said cover comprising:

three or more sections including a right side section, a left side section, a front section, a rear section, a bottom section and a top section, each of which includes at least one impact absorbing fluid-fillable and exhaustible, sealed bladder, wherein the sections are connected one to the other to define a box-like open interior area and having an opening at the top for receiving the drive unit of the motor including a propeller thereof.

15. The collapsible cover of claim 14, wherein said at least one impact absorbing fluid-fillable and exhaustible sealed bladder is an air bladder.

16. The collapsible cover of claim 14, further comprising a sleeve framing an opening, said sleeve having an outer edge.

17. The collapsible cover of claim 16, further comprising a cord located within the material of the outer edge for adjusting the size of the opening.

18. The collapsible cover of claim 16, further comprising a strip of material between the sleeve and an outer covering for reinforcing the connection therebetween.

19. The collapsible cover of claim 18, further comprising at least one grommet for the insertion of a locking device so that the cover may be secured to the drive unit.

20. The collapsible cover of claim 14, further comprising an adjustable length strap secured to the sides of the cover.

21. The collapsible cover of claim 20, further comprising a pad, wherein the pad slides over the adjustable length strap so that it may be placed along the strap where the strap contacts the drive unit.

22. The collapsible cover of claim 14, further comprising a layer of material attached at various points to the cover and located in the open interior area of the cover.

23. The collapsible cover of claim 22, wherein the layer of material is a rubber material covering those sections of the open interior area which would come into contact with the blades of the propeller, the anti-cavitation fins and the skeg.

24. The collapsible cover of claim 14, further comprising an aperture for allowing a support bar to pass therethrough.

25. The collapsible cover of claim 14, further comprising an adjustable length strap that is secured to the sides of the cover.

26. The collapsible cover of claim 14, further comprising a first zipper running through the rear section of the cover.

27. The collapsible cover of claim 26, further comprising a pair of second zippers, each of said second zippers running through a side section and a portion of the rear section for allowing a pair of hydrofoils to pass therethrough.

28. An in and out of water cover assembly for a drive unit of a motor powered boat, said assembly comprising, in combination:

a collapsible cover comprising:

at least one impact absorbing section shaped to receive and surround a lower portion of the drive unit including a propeller, wherein the impact absorbing section includes an outer material layer, an inner material layer, and a pocket defined between the inner layer and the outer layer for receiving an impact absorbing material; and a sack for receiving said collapsible cover.

29. The cover assembly of claim 28 further comprising a strap that is removably secured to said sack, wherein when said cover assembly is located on a drive unit of a boat, said strap is designed to be remotely secured to a steering wheel of the boat to remind an operator of the boat that the cover assembly is in place on the boat's drive unit.

* * * * *